US011013278B2

(12) United States Patent
Watson

(10) Patent No.: US 11,013,278 B2
(45) Date of Patent: May 25, 2021

(54) ADHESIVE SPORT TISSUE

(71) Applicant: Patrick Watson, Bellmawr, NJ (US)

(72) Inventor: Patrick Watson, Bellmawr, NJ (US)

( * ) Notice: Subject to any disclaimer, the term of this patent is extended or adjusted under 35 U.S.C. 154(b) by 119 days.

(21) Appl. No.: 16/154,830

(22) Filed: Oct. 9, 2018

(65) Prior Publication Data

US 2019/0297971 A1 Oct. 3, 2019

Related U.S. Application Data

(60) Provisional application No. 62/648,751, filed on Mar. 27, 2018.

(51) Int. Cl.
*A41D 20/00* (2006.01)
*A41D 31/102* (2019.01)

(52) U.S. Cl.
CPC ..... *A41D 20/00* (2013.01); *A41D 31/102* (2019.02); *A41D 2300/32* (2013.01); *A41D 2300/328* (2013.01); *A41D 2400/36* (2013.01); *A41D 2400/52* (2013.01); *A41D 2400/72* (2013.01)

(58) Field of Classification Search
CPC ..... A41D 2400/36; A41D 2400/52; A41D 2400/72; A61F 2013/49068; A61F 2013/15008; A61F 13/5611; A61F 13/58; A61F 13/60; A61F 13/40974; A61F 13/539
USPC ..... 2/46, 54, 56, 49.4; 604/385.01, 3, 21, 604/23, 386, 387, 393
See application file for complete search history.

(56) References Cited

U.S. PATENT DOCUMENTS

| | | | | |
|---|---|---|---|---|
| 4,536,889 | A | 8/1985 | Taylor et al. | |
| 6,280,529 | B1 | 8/2001 | Meyer | |
| 6,308,333 | B1 * | 10/2001 | Jackson | A41B 13/10 2/49.1 |
| 7,559,159 | B1 * | 7/2009 | Lundberg | A43B 3/163 36/7.1 R |
| 7,690,050 | B2 * | 4/2010 | Stockhamer | A41D 1/04 2/16 |
| 7,766,014 | B2 | 8/2010 | Piret | |
| 8,791,322 | B2 * | 7/2014 | Sacco | A61F 13/551 604/378 |
| 2003/0045852 | A1 * | 3/2003 | Esselburn | A61F 13/551 604/385.14 |
| 2005/0125877 | A1 * | 6/2005 | Benjamin | A41D 19/01 2/158 |
| 2007/0118943 | A1 | 5/2007 | Stockhamer | |

(Continued)

*Primary Examiner* — Gloria M Hale
(74) *Attorney, Agent, or Firm* — Boudwin Intellectual Property; Daniel Boudwin

(57) ABSTRACT

An adhesive sport tissue having an elongated absorbent body including a first end and a second end of predetermined length, and a pair of opposing side edges of predetermined width extending between the first end and the second end. The adhesive sport tissue further comprising a front side and a rear side, wherein the rear side is securable to a user's skin or an article of clothing such that the front side faces away from the user. At least one sheet is disposed on the front side that is selectively removable by the user. The adhesive sport tissue further includes an upper layer that is permeable to moisture and a moisture-absorbent inner core layer that tapers inwardly from the pair of opposing side edges, and a plurality of adhesive strips disposed on the rear side. In one embodiment, a scented layer is also included.

1 Claim, 4 Drawing Sheets

(56) References Cited

U.S. PATENT DOCUMENTS

| | | | | |
|---|---|---|---|---|
| 2007/0157361 | A1* | 7/2007 | Martz | A61F 13/14 2/69 |
| 2008/0103474 | A1* | 5/2008 | Luizzi | A61F 13/5605 604/387 |
| 2008/0319411 | A1* | 12/2008 | Mortensen | A61F 13/4702 604/387 |
| 2010/0293693 | A1* | 11/2010 | Lee | A41D 1/215 2/46 |
| 2011/0088132 | A1 | 4/2011 | McNamee-Sollars | |
| 2014/0049004 | A1 | 2/2014 | Del V | |
| 2014/0180232 | A1* | 6/2014 | Gagliardi | A61F 13/15577 604/367 |

* cited by examiner

ADHESIVE SPORT TISSUE

CROSS REFERENCE TO RELATED APPLICATIONS

This application claims the benefit of U.S. Provisional Application No. 62/648,751 filed on Mar. 27, 2018. The above identified patent application is herein incorporated by reference in its entirety to provide continuity of disclosure.

BACKGROUND OF THE INVENTION

The present invention relates to an adhesive sport tissue. Many people enjoy exercising, including jogging, hiking, biking, and the like. However, bodily fluids can be a cause of frustration for the user, as fluids such as sweat, nasal drainage, and the like can distract the user, requiring attention to be split between the desired activity and managing the fluid buildup. Frequently, people must stop, locate an absorbent article such as tissues or a towel, and wipe up the offending fluids. However, stopping mid-workout can negatively impact an individual's workout. Additionally, being forced to carry additional absorbent articles can be cumbersome. Therefore, a device that allows a user to manage sweat and other fluid buildup during a workout without stopping the workout is desired.

Devices have been disclosed in the known art that relate to adhesive wipes. These include devices that have been patented and published in patent publications. However, these devices do not disclose the combination of a wipe with an adhesive backing, a body having an inwardly tapered center portion, indicia disposed on an uppermost layer of the body, and a scented layer.

SUMMARY OF THE INVENTION

In view of the foregoing disadvantages inherent in the known art it is submitted that the present invention substantially diverges in design elements from the prior art and consequently it is clear that there is a need in the art for an improvement to existing adhesive sport garments or tissues. In this regard the instant invention substantially fulfills these needs.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 2:
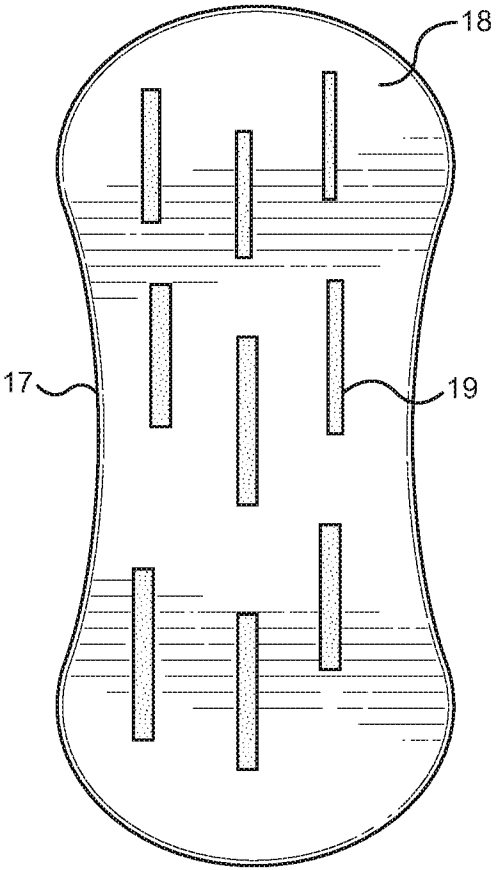
FIG. 2 shows a bottom plan view of the rear of the adhesive sport tissue.

Reference is made herein to the attached drawings. Like reference numerals are used throughout the drawings to depict like or similar elements of the adhesive sport tissue. The figures are intended for representative purposes only and should not be considered to be limiting in any respect.

Figure 1:
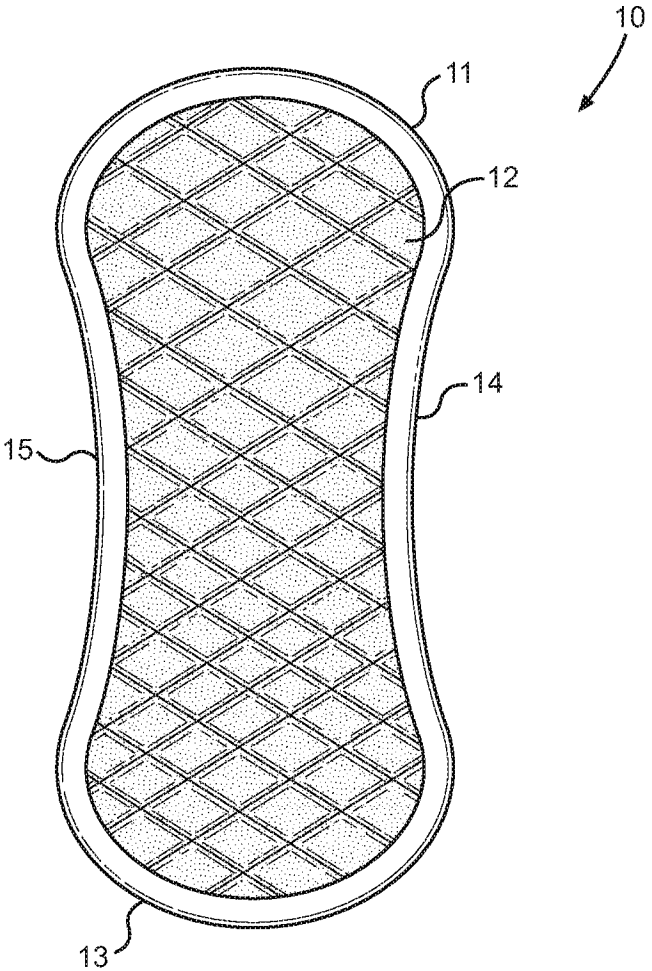
FIG. 1 shows a top plan view of the adhesive sport tissue.

Referring now to FIGS. 1 and 2, there is shown a top plan view of the adhesive sport tissue and a bottom plan view of the adhesive sport tissue, respectively. The adhesive sport tissue 10 comprises an elongated absorbent body 14 having a first end 11 a second end 13 of predetermined length, a pair of opposing side edges 14, 15 of predetermined width extending from the first end 11 to the second end 13, and a front side 12 and rear side 18. In the shown embodiment, the elongated absorbent body 14 tapers inwardly from each of first and second ends 11, 13, such that a central portion of the elongated absorbent body 14 includes a diameter that is less than a diameter of the first and second ends, allowing the user's limbs to bend and flex without disturbing the placement of the adhesive sport tissue 10. The rear side 18 is securable to a wearer's skin or an article of clothing such that the front side 12 faces away from the user.

The adhesive sport tissue 10 further comprises at least one absorbent sheet disposed on the front side 12. The absorbent sheet includes an upper layer that is permeable to moisture and an inner core layer that tapers inwardly from the pair of opposing side edges 14, 15 and is configured to absorb moisture, such as excreted bodily fluids. In one embodiment, the adhesive sport tissue 10 is made of a cotton fabric and includes a mesh material or a similar type of absorbent material, wherein the mesh forms a cross-pattern with the cotton material to increase absorption. The absorbent sheet on the front side 12 is soft and non-irritating to the wearer's skin with elastic characteristics allowing it to stretch in at least one direction.

In the shown embodiment, the adhesive sport tissue 10 includes a plurality of adhesive strips 17 disposed on the rear side 18 of the adhesive sport tissue 10 wherein the plurality of adhesive strips is covered with at least one removable protective sheet 19. The rear side 18 of the adhesive sport tissue 10 is liquid impermeable and is made of a thin plastic film or any other suitable flexible material can be used to keep out moisture. The rear side 18 also includes an elastic material, allowing it to stretch in at least one direction. In an alternate embodiment, the adhesive sport tissue 10 includes a plurality of hook and loop type fasteners on the rear side 18 of the adhesive sport tissue 10. In embodiments that include hook and loop fasteners, a first attachment surface of looped fibers is removed from a second attachment surface of hooks in order to secure the adhesive sport tissue 10 to a suitable surface.

Figure 3:
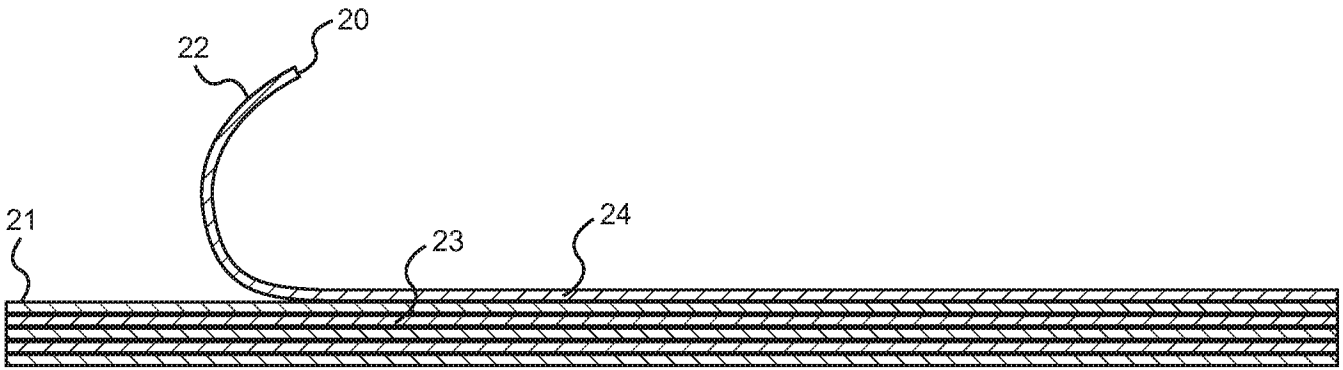
FIG. 3 shows a side view of an embodiment of the adhesive sport tissue showing the removal of the top absorbent sheet.

Referring now to FIG. 3, there is shown a side view of an embodiment of the adhesive sport tissue during the removal of the top absorbent sheet. In the shown embodiment, the top absorbent sheet 22 is disposed on the front side of the adhesive sport tissue, wherein the absorbent sheets 22 are disposed in a stacked arrangement 23, i.e., one on top of the other, such that the upper layer 20 of liquid permeable material is exposed, allowing liquid to be absorbed by the inner core 24. When ready to use the adhesive sport tissue, the user peels the top absorbent sheet 22 from the stack of sheets 23 and removes it completely from the remaining stack of sheets 23 and proceeds to selectively wipe bodily excretions. The absorbent sheet 22 is then discarded leaving the next absorbent sheet 22 ready for use. The absorbent sheets 22 are adapted to adhere to each other through use of an adhesive fabric included on the adhesive sport tissue.

Figure 4:
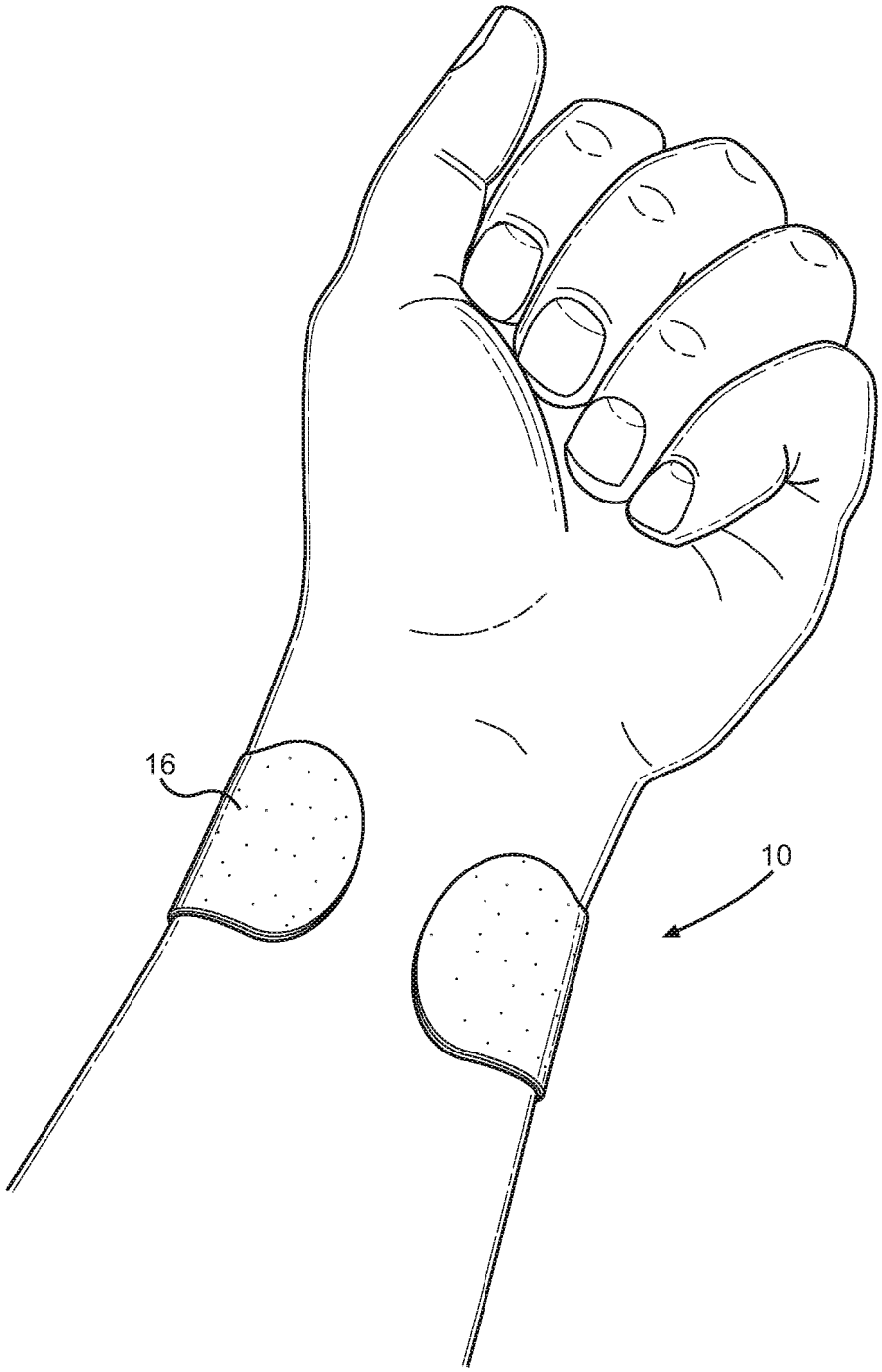
FIG. 4 shows a perspective view of the adhesive sport tissue in use.
Figure 5:
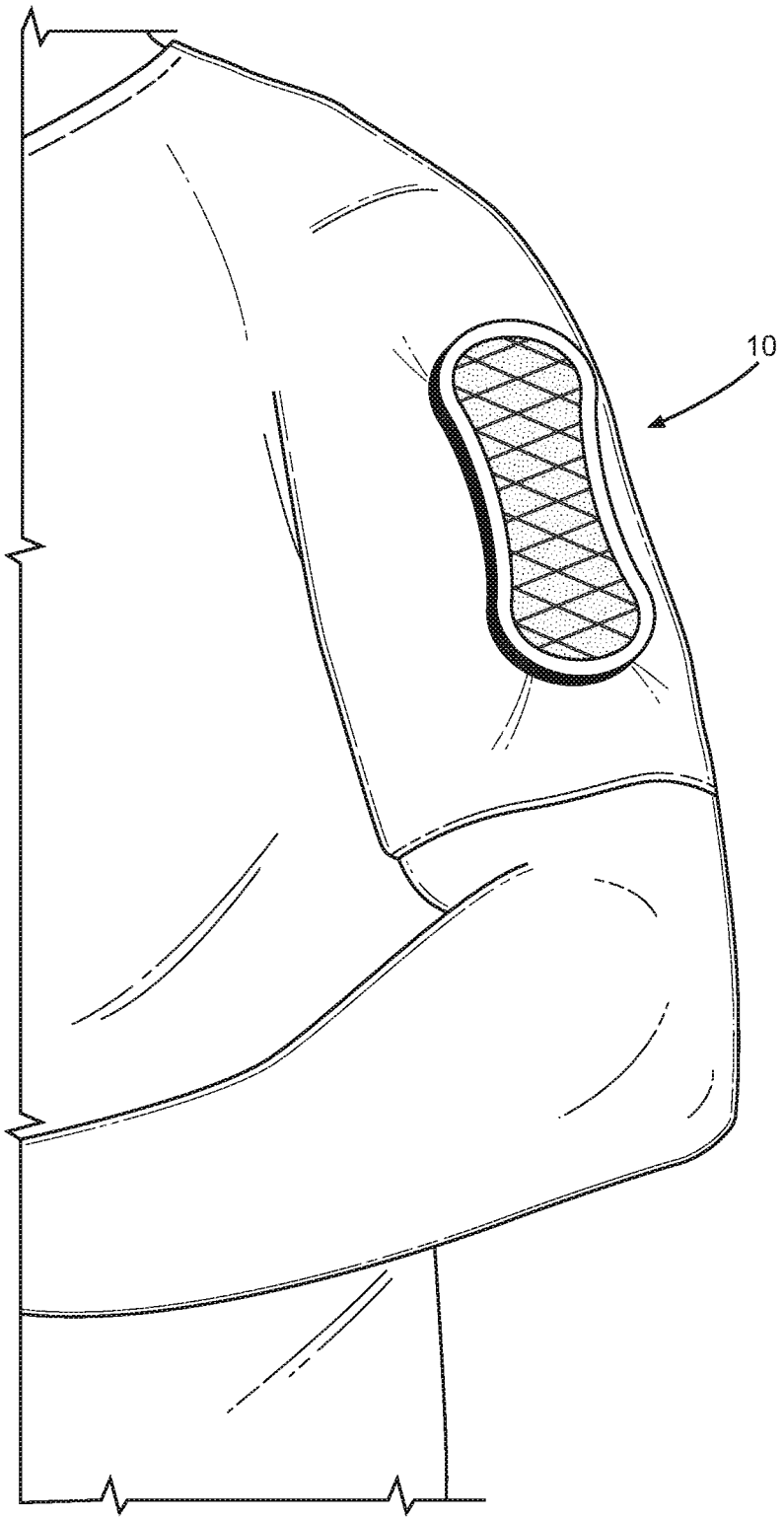
FIG. 5 shows an alternate perspective view of the adhesive sport tissue in use.

Referring now to FIG. 4 and FIG. 5, there is shown a perspective view of the adhesive sport tissue in use and an alternate perspective view of the adhesive sport tissue in use, respectively. In embodiment shown in FIG. 4, the adhesive sport tissue 10 is secured to the user's arm such that the front side faces away from the user and the rear side is removably secured to the user's skin. In an alternate embodiment, the upper layer of the adhesive sport tissue 10 is embedded with a selected scent. For example, if the user is a hunter, the upper layer of the adhesive sport tissue 10 is adapted to hold a scent that masks the user's smell such that the user would be undetected by an animal being hunted. The upper layer can include various scents, such as lavender, lemon, or orange, for example. In an alternate embodiment, the front side of the adhesive sport tissue 10 comprises indicia thereon for advertising or ornamental purposes. The indicia are selected by the user and adapted to fit on the front side of the adhesive sport tissue 10. Examples of indicia include a sport's team name, a company name, or the user's name. In the embodiment shown in FIG. 5, the adhesive sport tissue 10 is secured to the user's clothing such that the front side faces away from the user and the rear side is removably secured to the outside surface of the user's clothing.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adhesive sport tissue, consisting of:

an elongated absorbent body having a first end a second end;

a pair of opposing side edges extending from the first end to the second end;

a front side and rear side, wherein the rear side is adapted to removably secure to a surface via a plurality of adhesive strips disposed on the rear side such that the front side faces away from the surface;

at least one selectively removable absorbent sheet disposed on the front side, wherein the absorbent sheet includes an upper layer that is permeable to moisture and an inner core layer that tapers inwardly from the pair of opposing side edges and is configured to absorb moisture.

* * * * *